US007880387B2

(12) United States Patent
Ohtoh et al.

(10) Patent No.: US 7,880,387 B2
(45) Date of Patent: Feb. 1, 2011

(54) PLASMA DISPLAY PANEL HAVING A CRYSTALLINE MAGNESIUM OXIDE LAYER

(75) Inventors: Takashi Ohtoh, Yamanashi-ken (JP); Kunimoto Tsuchiya, Yamanashi-ken (JP)

(73) Assignee: Panasonic Corporation, Osaka (JP)

( * ) Notice: Subject to any disclaimer, the term of this patent is extended or adjusted under 35 U.S.C. 154(b) by 325 days.

(21) Appl. No.: 11/267,171

(22) Filed: Nov. 7, 2005

(65) Prior Publication Data

US 2006/0261738 A1 Nov. 23, 2006

(30) Foreign Application Priority Data

Nov. 8, 2004 (JP) ..... 2004-323240

(51) Int. Cl.
*G09G 3/10* (2006.01)
*H01J 17/49* (2006.01)

(52) U.S. Cl. ..... 313/587; 313/582; 313/584; 445/24; 445/25; 315/169.4

(58) Field of Classification Search ..... 313/582, 313/584
See application file for complete search history.

(56) References Cited

U.S. PATENT DOCUMENTS 5,818,168 A * 10/1998 Ushifusa et al. ..... 313/582
5,883,462 A * 3/1999 Ushifusa et al. ..... 313/292
6,486,611 B2 * 11/2002 Tokunaga et al. ..... 315/169.4
6,586,880 B2 * 7/2003 Amemiya et al. ..... 313/582
6,614,183 B2 * 9/2003 Masuda et al. ..... 313/586
6,639,363 B2 * 10/2003 Amatsuchi et al. ..... 313/582
7,078,859 B2 * 7/2006 Yoshihara et al. ..... 313/587
7,456,575 B2 * 11/2008 Miyata et al. ..... 313/587
7,535,178 B2 * 5/2009 Ushizawa et al. ..... 313/586
2003/0227426 A1 * 12/2003 Yoshinari ..... 345/60
2004/0075388 A1 * 4/2004 Miyashita et al. ..... 313/586
2004/0113553 A1 * 6/2004 Yoon et al. ..... 313/582
2007/0013306 A1 * 1/2007 Hai et al. ..... 313/582

FOREIGN PATENT DOCUMENTS

EP 0 823 722 A2 7/1997
EP 1 600 921 A2 5/2005
EP 1 580 786 A2 9/2005
EP 1 638 127 A2 3/2006
JP 2000-285808 10/2000

OTHER PUBLICATIONS

Saksena, B.D.; Pant, L.M.; Cathodo-luminescence of MGO; Nov. 1954 Proceedings of the Physical Society. Section B 67 p. 811-816.*

* cited by examiner

*Primary Examiner*—Sikha Roy
*Assistant Examiner*—Tracie Y Green
(74) *Attorney, Agent, or Firm*—McGinn IP Law Group, PLLC

(57) ABSTRACT

A PDP is equipped with a front glass substrate and a back glass substrate which face each other on either side of a discharge space, row electrode pairs formed on the front glass substrate, a dielectric layer covering the row electrode pairs, a protective layer covering the dielectric layer, and a partition wall unit partitioning the discharge space into discharge cells. The partition wall unit has an approximate grid shape. The protective layer has a crystalline MgO layer essentially containing an MgO crystal causing a cathode-luminescence emission having a peak within a wavelength range of 200 nm to 300 nm upon excitation by an electron beam.

23 Claims, 8 Drawing Sheets

EMBODIMENT

SECTION V-V

SECTION W-W

SINGLE CRYSTAL OF
CUBIC SINGLE-CRYSTAL
STRUCTURE

SINGLE CRYSTALLINE MgO
OF CUBIC POLYCRYSTAL
STRUCTURE

PLASMA DISPLAY PANEL HAVING A CRYSTALLINE MAGNESIUM OXIDE LAYER

BACKGROUND OF THE INVENTION

1. Field of the Invention

This invention relates to a structure of plasma display panels.

The present application claims priority from Japanese Application No. 2004-323240, the disclosure of which is incorporated herein by reference.

2. Description of the Related Art

A surface-discharge-type alternating-current plasma display panel (hereinafter referred to as "PDP") has two opposing glass substrates placed on either side of a discharge-gas-filled discharge space. On one of the two glass substrates, row electrode pairs extending in the row direction are regularly arranged in the column direction. On the other glass substrate, column electrodes extending in the column direction are regularly arranged in the row direction. Unit light emission areas (discharge cells) are formed in matrix form in positions corresponding to the intersections between the row electrode pairs and the column electrodes in the discharge space. Phosphor layers to which red, green and blue colors are individually applied are provided in the respective unit light emission areas in the discharge space.

The PDP further has a dielectric layer provided for covering the row electrodes or the column electrodes. A magnesium oxide (MgO) film is formed on a portion of the dielectric layer facing each of the unit light emission areas. The MgO film has the function of protecting the dielectric layer and the function of emitting secondary electrons into the unit light emission area.

The recently dominant one of PDPs structured as described above has an approximate grid shaped partition wall unit provided between the two glass substrates to partition the discharge space into the unit light emission areas.

Such a conventional PDP is disclosed in Japanese Patent Laid-open Application No. 2000-285808, for example.

The PDP having such a partition wall unit has the advantage of an improvement in brightness because the surface area of the phosphor layers is increased by forming the phosphor layers on the side faces of the partition wall unit. However, when, due to the formation of the partition wall unit, adjacent unit light emission areas arranged in the column direction are blocked off from each other, the amount of priming particles traveling between the adjacent unit light emission areas in the column direction is decreased. This decrease in turn gives rise to the problem of a reduction in the discharge probability of the address discharge caused for selecting the unit light emission areas for light emission, for example.

SUMMARY OF THE INVENTION

It is an object of the present invention to solve the problem associated with conventional PDPs having a grid-shaped partition wall unit defining unit light emission areas as described above.

To attain this object, a plasma display panel according to the present invention is equipped with a front substrate and a back substrate facing each other on either side of a discharge space. Further, a plurality of row electrode pairs is formed on either the front substrate or the back substrate. A plurality of column electrodes formed on either the front substrate or the back substrate. A dielectric layer covers the row electrode pairs. A protective layer covers the dielectric layer and has a crystalline magnesium oxide layer including a magnesium oxide crystal causing a cathode-luminescence emission having a peak within a wavelength range of 200 nm to 300 nm upon excitation by an electron beam. A partition wall unit is provided between the front substrate and the back substrate for partitioning the discharge space into unit light emission areas each corresponding to an intersection between the row electrode pair and the column electrode. The partition wall unit is formed in an approximate grid shape having transverse walls and vertical walls surrounding the unit light emission areas individually.

In an exemplary embodiment of the present invention, a PDP has a front glass substrate and a back glass substrate between which row electrode pairs each extend in the row direction and column electrodes each extend in the column direction to form discharge cells in the discharge space at the intersections with the row electrode pairs. A partition wall unit, which has vertical walls and transverse walls and is formed in an approximate grid shape, partitions the discharge space into the discharge cells. A dielectric layer covers the row electrode pairs and, in turn, a protective layer covers the face of the dielectric layer. The protective layer has a crystalline MgO layer including an MgO crystal causing a cathode-luminescence emission having a peak within a wavelength range of 200 nm to 300 nm (particularly, from 230 nm to 250 nm, around 235 nm) upon excitation by an electron beam.

In the PDP of the exemplary embodiment, the crystalline MgO layer included in the protective layer for the dielectric layer includes the MgO crystal that causes a cathode-luminescence emission having a peak within a wavelength range from 200 nm to 300 nm upon excitation by an electron beam. Because of this design, a decrease in the discharge probability of discharge produced in the discharge cell is prevented even if the adjacent discharge cells C in the column direction are blocked off from each other by providing the grid-shaped partition wall unit. In consequence, it is possible to realize compatibility between the effect of improving the discharge probability, and an improvement in brightness of the PDP and an increase in the number of gray levels which are achieved by providing the partition wall unit.

These and other objects and features of the present invention will become more apparent from the following detailed description with reference to the accompanying drawings.

DETAILED DESCRIPTION OF THE PREFERRED EMBODIMENT

Figure 1:
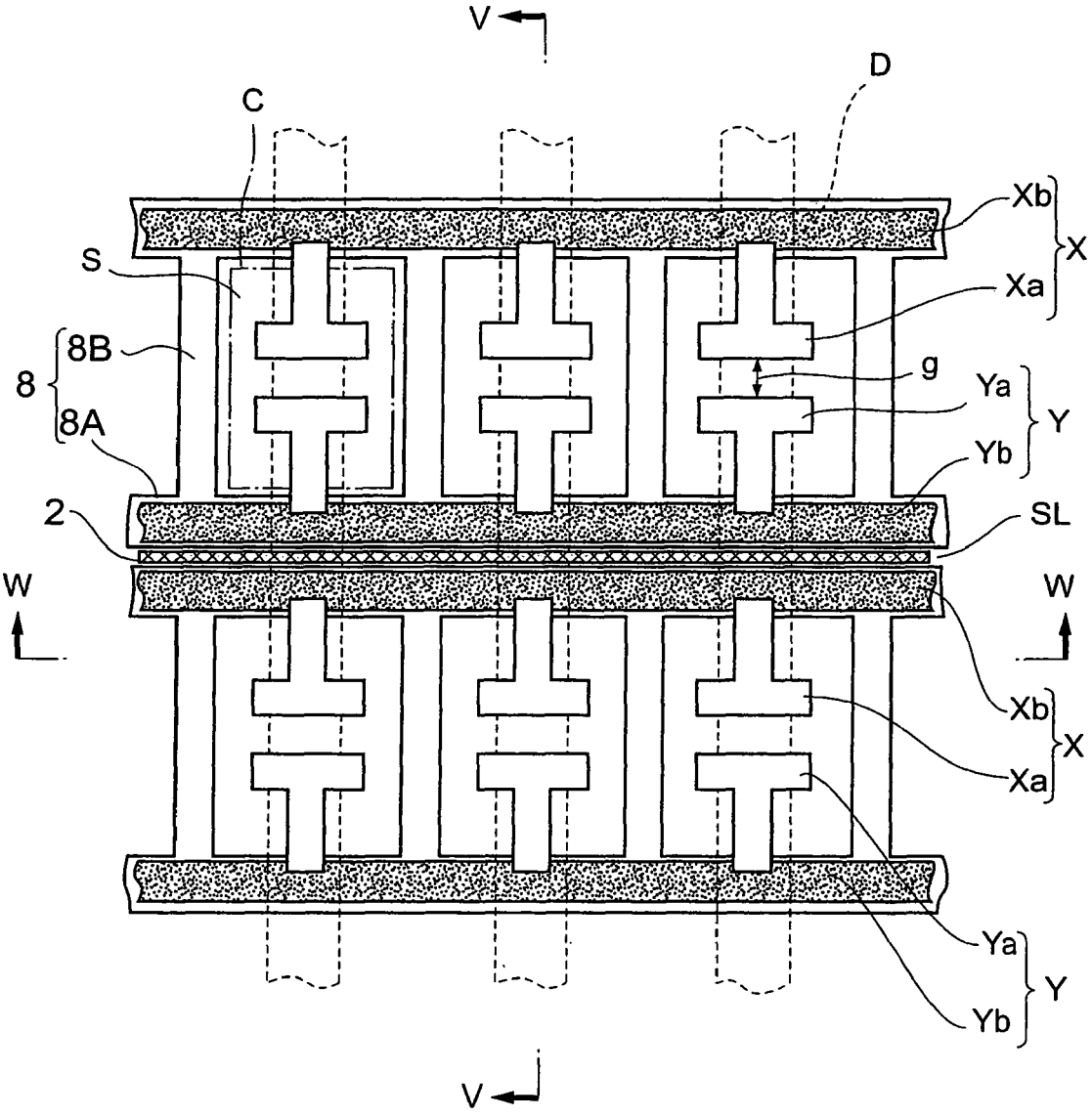
FIG. 1 is a front view illustrating an embodiment of the present invention.
Figure 2:
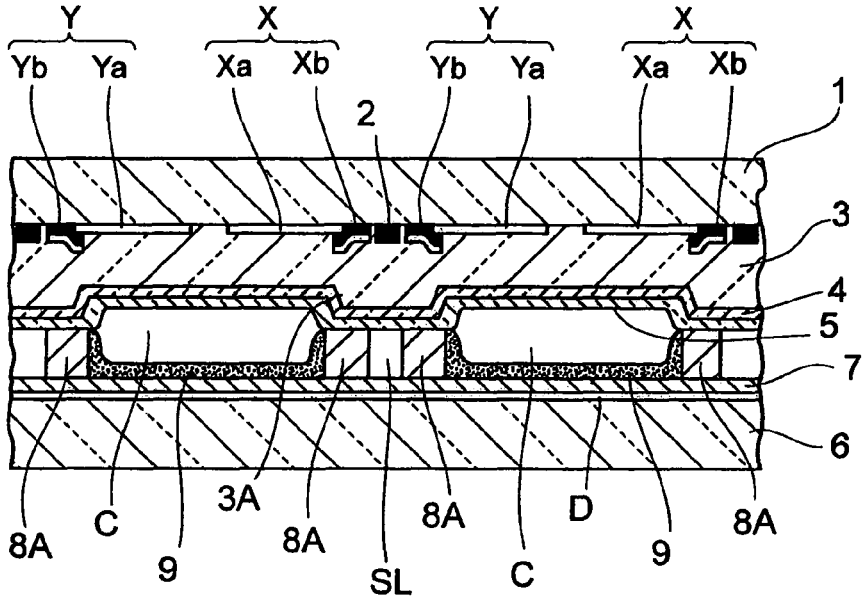
FIG. 2 is a sectional view taken along the V-V line in FIG. 1.
Figure 3:
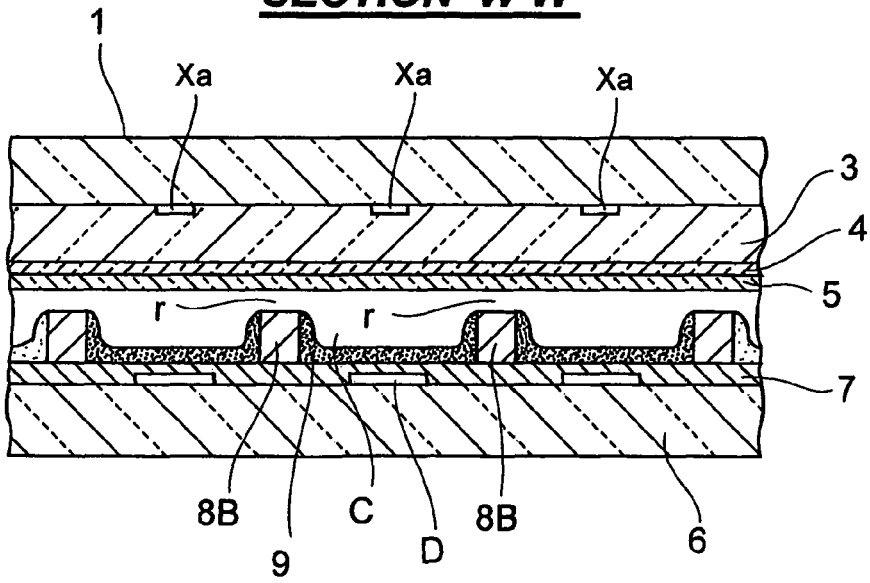
FIG. 3 is a sectional view taken along the W-W line in FIG. 1.

FIGS. 1 to 3 illustrate an embodiment of a PDP according to the present invention. FIG. 1 is a schematic front view of the PDP in the embodiment. FIG. 2 is a sectional view taken along the V-V line in FIG. 1. FIG. 3 is a sectional view taken along the W-W line in FIG. 1.

The PDP in FIGS. 1 to 3 has a plurality of row electrode pairs (X, Y) extending and arranged in parallel on the rear-facing face (the face facing toward the rear of the PDP) of a front glass substrate 1 serving as a display surface in a row direction of the front glass substrate 1 (the right-left direction in FIG. 1).

A row electrode X is composed of T-shaped transparent electrodes Xa formed of a transparent conductive film made of ITO or the like, and a bus electrode Xb formed of a metal film. The bus electrode Xb extends in the row direction of the front glass substrate 1. The narrow proximal end (corresponding to the foot of the "T") of each transparent electrode Xa is connected to the bus electrode Xb.

Likewise, a row electrode Y is composed of T-shaped transparent electrodes Ya formed of a transparent conductive film made of ITO or the like, and a bus electrode Yb formed of a metal film. The bus electrode Yb extends in the row direction of the front glass substrate 1. The narrow proximal end of each transparent electrode Ya is connected to the bus electrode Yb.

The row electrodes X and Y are arranged in alternate positions in a column direction of the front glass substrate 1 (the vertical direction in FIG. 1). In each row electrode pair (X, Y), the transparent electrodes Xa and Ya are regularly spaced along the associated bus electrodes Xb and Yb and each extends out toward its counterpart in the row electrode pair, so that the wide distal ends (corresponding to the head of the "T") of the transparent electrodes Xa and Ya face each other on either side of a discharge gap g having a required width.

Black- or dark-colored light absorption layers (light-shield layers) 2 are further formed on the rear-facing face of the front glass substrate 1. Each of the light absorption layers 2 extends in the row direction along and between the back-to-back bus electrodes Xb and Yb of the row electrode pairs (X, Y) adjacent to each other in the column direction.

A dielectric layer 3 is formed on the rear-facing face of the front glass substrate 1 so as to cover the row electrode pairs (X, Y), and has additional dielectric layers 3A projecting from the rear-facing face thereof. Each of the additional dielectric layers 3A extends in parallel to the back-to-back bus electrodes Xb, Yb of the adjacent row electrode pairs (X, Y) on a portion of the rear-facing face of the dielectric layer 3 opposite to the bus electrodes Xb, Yb and the area between the bus electrodes Xb, Yb.

On the rear-facing faces of the dielectric layer 3 and the additional dielectric layers 3A, a magnesium oxide layer 4 of thin film (hereinafter referred to as "thin-film MgO layer 4") formed by vapor deposition or spattering covers the entire rear-facing faces of the layers 3 and 3A.

A magnesium oxide layer 5 including a magnesium oxide crystal having a cubic crystal structure as described later (hereinafter referred to as "crystalline MgO layer 5") is formed on the rear-facing face of the thin-film MgO layer 4.

The crystalline MgO layer 5 is formed on the entire rear face of the thin-film MgO layer 4 or a part of the rear face thereof, e.g. part facing each discharge cell described later (in the example shown in FIGS. 1 to 3, the crystalline MgO layer 5 is formed on the entire rear face of the thin-film MgO layer 4).

The front glass substrate 1 is parallel to a back glass substrate 6. Column electrodes D are arranged in parallel at predetermined intervals on the front-facing face (the face facing toward the display surface) of the back glass substrate 6. Each of the column electrodes D extends in a direction at right angles to the row electrode pair (X, Y) (i.e. the column direction) along a strip opposite to the paired transparent electrodes Xa and Ya of each row electrode pair (X, Y)

On the front-facing face of the back glass substrate 6, a white column-electrode protective layer (dielectric layer) 7 covers the column electrodes D and in turn a partition wall unit 8 is formed on the column-electrode protective layer 7.

The partition wall unit 8 is formed in an approximate grid shape made up of a plurality of transverse walls 8A and a plurality of vertical walls 8B. The transverse walls 8A each extending in the row direction on a portion of the column-electrode protective layer 7 opposite the bus electrode Xb, Yb of each row electrode pair (X, Y) are regularly arranged in the column direction. The vertical walls 8B each extending in the column direction on a portion of the column-electrode protective layer 7 between the adjacent column electrodes D are regularly arranged in the row direction.

In each of the transverse walls 8A of the partition wall unit 8, an interstice SL extending in the row direction is formed.

The grid-shaped partition wall unit 8 partitions the discharge space S defined between the front glass substrate 1 and the back glass substrate 6 into quadrangles to form discharge cells C each corresponding to the paired transparent electrodes Xa and Ya of each row electrode pair (X, Y).

In each discharge cell C, a phosphor layer 9 covers five faces: the side faces of the transverse walls 8A and the vertical walls 8B of the partition wall unit 8 and the face of the column-electrode protective layer 7. The three primary colors, red, green and blue, are individually applied to the phosphor layers 9 such that the red, green and blue discharge cells C are arranged in order in the row direction.

The crystalline MgO layer 5 covering the additional dielectric layers 3A (or the thin-film MgO layer 4 in the case where the crystalline MgO layer 5 is formed on each portion of the rear-facing face of the thin-film MgO layer 4 facing the discharge cell C) is in contact with the front-facing face of the transverse walls 8A of the partition wall unit 8 (see FIG. 2), so that each of the additional dielectric layers 3A blocks off the discharge cell C and the interstice SL formed in each transverse wall 8A from each other. However, the crystalline MgO layer 5 is out of contact with the front-facing face of the vertical walls 8B (see FIG. 3). As a result, a clearance r is formed between the crystalline MgO layer 5 and each of the vertical walls 8B, so that the adjacent discharge cells C in the row direction communicate with each other by means of the clearance r.

The discharge space S is filled with a discharge gas including xenon.

For the buildup of the crystalline MgO layer 5, a spraying technique, electrostatic coating technique or the like is used to cause the MgO crystal as described earlier to adhere to the rear-facing face the thin-film MgO layer 4 covering the dielectric layer 3 and the additional dielectric layers 3A.

The embodiment describes the case of the crystalline MgO layer 5 being formed on the rear-facing face of the thin-film MgO layer 4 that has been formed on the rear-facing faces of the dielectric layer 3 and the additional dielectric layers 3A. However, a crystalline MgO layer 5 may be formed on the rear-facing faces of the dielectric layer 3 and the additional dielectric layers 3A and then the thin-film MgO layer 4 may be formed on the rear-facing face of the crystalline MgO layer 5.

Figure 4:
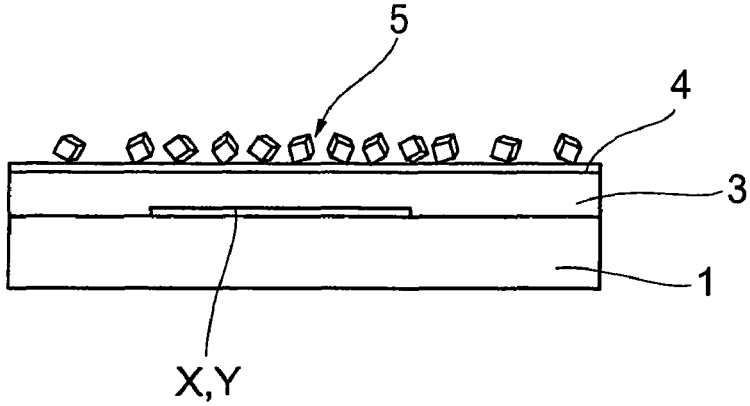
FIG. 4 is a sectional view showing the state of a crystalline magnesium oxide layer formed on a thin film magnesium layer in the embodiment.

FIG. 4 illustrates the state when the thin-film MgO layer 4 is first formed on the rear-facing face of the dielectric layer 3 and then an MgO crystal is affixed to the rear-facing face of the thin-film MgO layer 4 to form the crystalline MgO layer 5 by use of a spraying technique, electrostatic coating technique or the like.

Figure 5:
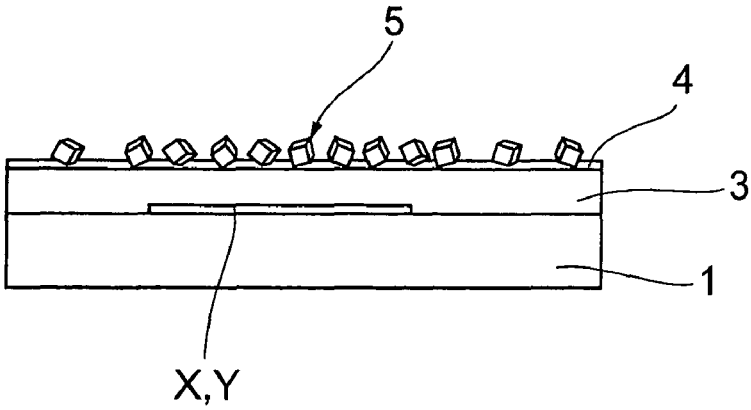
FIG. 5 is a sectional view showing the state of a thin film magnesium layer formed on a crystalline magnesium layer in the embodiment.

FIG. 5 illustrates the state when the MgO crystal is affixed to the rear-facing face of the dielectric layer 3 to form the crystalline MgO layer 5 by use of a spraying technique, electrostatic coating technique or the like, and then the thin-film MgO layer 4 is formed.

The single-crystalline MgO layer 5 of the PDP is formed by use of the following materials and method.

Figure 6:
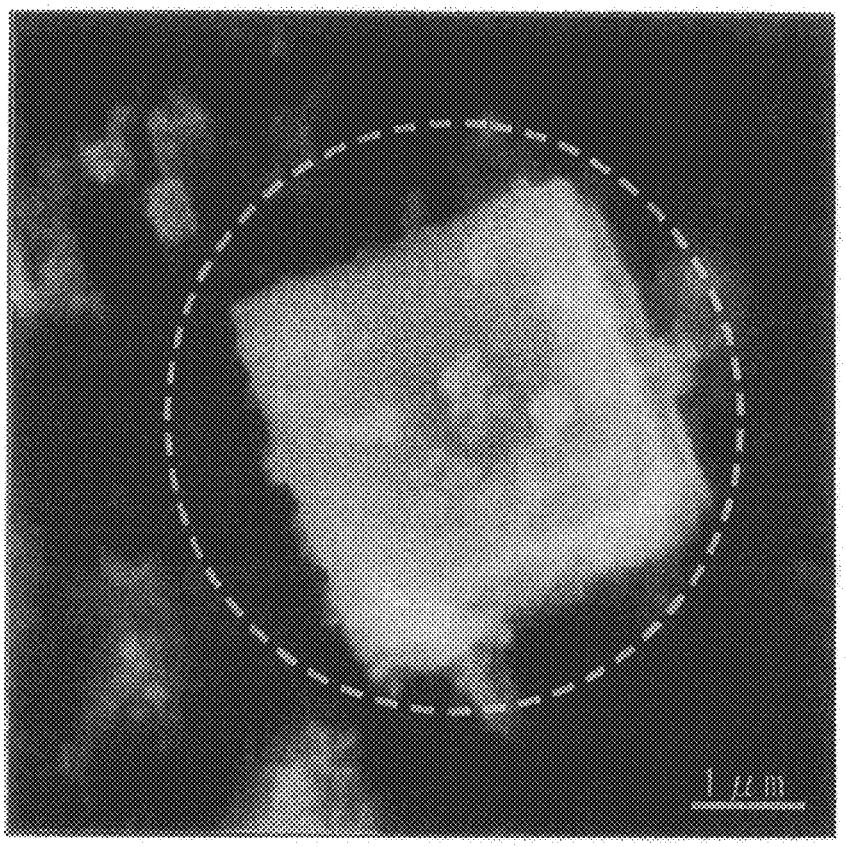
FIG. 6 is a SEM photograph of the magnesium oxide single crystal having a cubic single-crystal structure.
Figure 7:
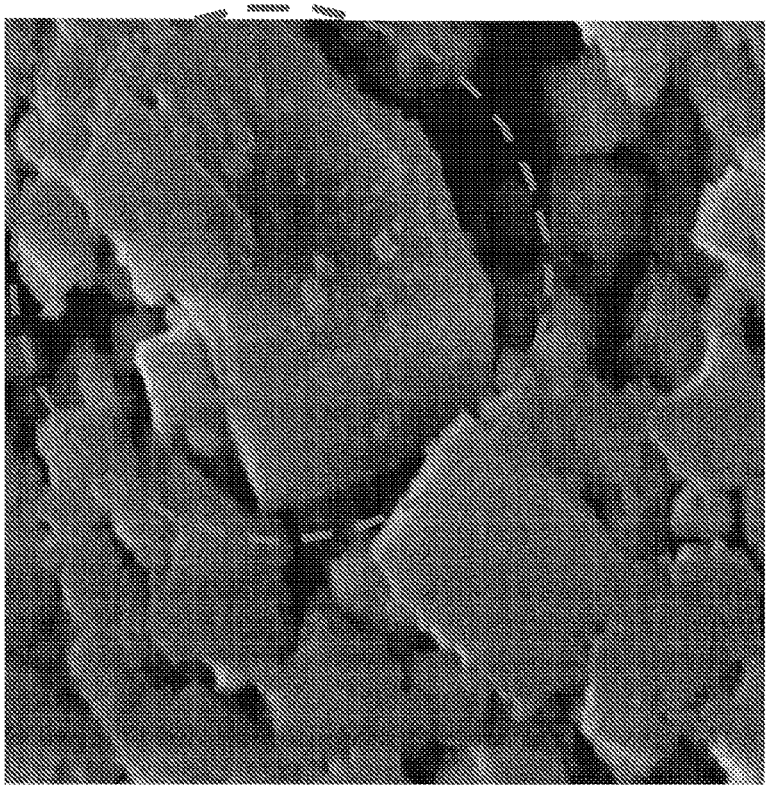
FIG. 7 is a SEM photograph of the magnesium oxide single crystal having a cubic polycrystal structure.

A MgO crystal, which is used as materials for forming the crystalline MgO layer 5 and cause CL emission having a peak within a wavelength range from 200 nm to 300 nm (particularly, from 230 nm to 250 nm, around 235 nm) by being excited by an electron beam, includes crystals such as a single crystal of magnesium obtained by performing vapor-phase oxidization on magnesium steam generated by heating magnesium (the single crystal of magnesium are hereinafter referred to as "vapor-phase MgO single crystal"). As the vapor-phase MgO single crystal are included an MgO single crystal having a cubic single crystal structure as illustrated in the SEM photograph in FIG. 6, and an MgO single crystal having a structure of a cubic crystal fitted to each other (i.e. a cubic polycrystal structure) as illustrated in the SEM photograph in FIG. 7, for example.

The vapor-phase MgO single crystal contributes to an improvement of the discharge characteristics such as a reduction in discharge delay as described later.

As compared with that obtained by other methods, the vapor-phase magnesium oxide single crystal has the features of being of a high purity, taking a microscopic particle form, causing less particle agglomeration, and the like.

The vapor-phase MgO single crystal used in the embodiment has an average particle diameter of 500 or more angstroms (preferably, 2000 or more angstroms) based on a measurement using the BET method.

Note that the preparation of the vapor-phase MgO single crystal is described in "Preparation of magnesia powder using a vapor phase method and its properties" ("Zairyou (Materials)" vol. 36, no. 410, pp. 1157-1161, the November 1987 issue), and the like.

The crystalline MgO layer 5 is formed by the affixation of the vapor-phase MgO single crystal by use of a spraying technique, electrostatic coating technique or the like as described earlier.

In the above-mentioned PDP, a reset discharge, an address discharge and a sustaining discharge for generating an image are produced in the discharge cell C.

When the reset discharge is produced in the discharge cell C, a long duration of the priming effect caused by the reset discharge is allowed by forming the crystalline MgO layer 5 in the discharge cell C. Because of this, the discharge probability of the address discharge produced after the reset discharge is improved even when the adjacent discharge cells C in the column direction are blocked off from each other by the transverse wall 8A of the partition wall unit 8 and the additional dielectric layer 3A as described earlier.

Figure 8:
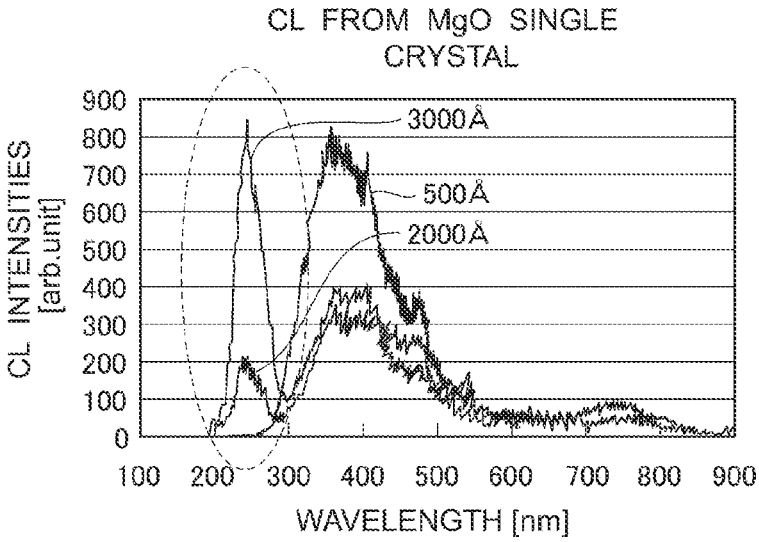
FIG. 8 is a graph showing the relationship between the particle size of a magnesium oxide single crystal and the wavelengths of CL emission in the embodiment.
Figure 9:
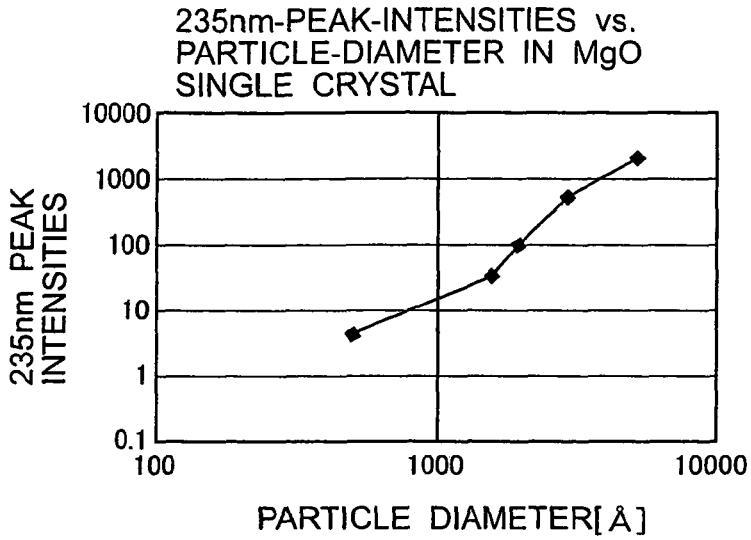
FIG. 9 is a graph showing the relationship between the particle size of a magnesium oxide single crystal and the intensities of CL emission at 235 nm in the embodiment.

Because the crystalline MgO layer 5 is formed of the vapor-phase MgO single crystal as described earlier, in the PDP the application of electron beam initiated by the discharge excites a CL emission having a peak within a wavelength range from 200 nm to 300 nm (particularly, from 230 nm to 250 nm, around 235 nm), in addition to a CL emission having a peak wavelength from 300 nm to 400 nm, from the large-particle-diameter vapor-phase MgO single crystal included in the crystalline MgO layer 5, as shown in FIGS. 8 and 9.

Figure 10:
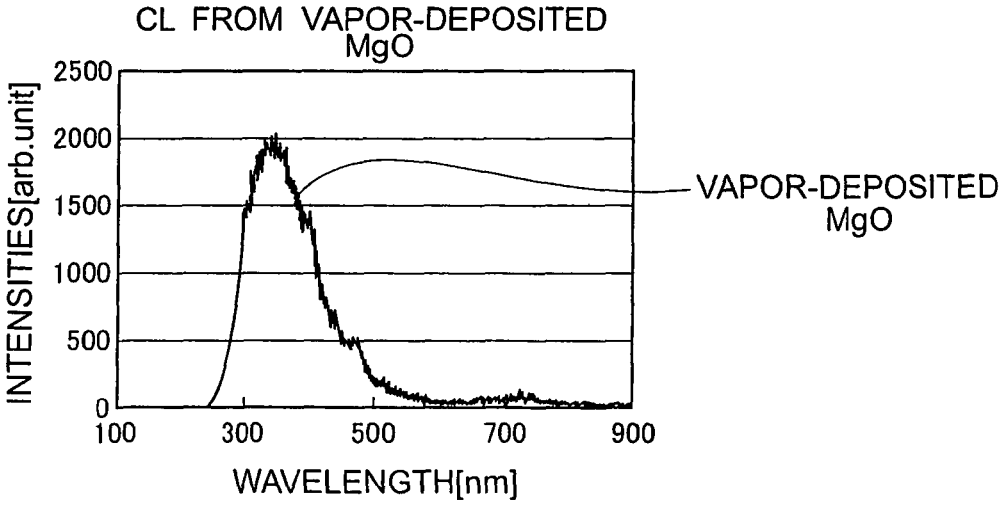
FIG. 10 is a graph showing the state of the wavelength of CL emission from the magnesium oxide layer formed by vapor deposition.

As shown in FIG. 10, a CL emission with a peak wavelength of 235 nm is not excited from a MgO layer formed typically by use of vapor deposition (the thin film MgO layer 4 in the embodiment), but only a CL emission having a peak wavelength between 300 nm and 400 nm is excited.

As seen from FIGS. 8 and 9, the greater the particle diameter of the vapor-phase MgO single crystal, the stronger the peak intensity of the CL emission having a peak within the wavelength range from 200 nm to 300 nm (particularly, from 230 nm to 250 nm, around 235 nm).

It is conjectured that the presence of the CL emission having the peak wavelength between 200 nm and 300 nm will bring about a further improvement of the discharge characteristics (a reduction in discharge delay, an increase in the discharge probability).

More specifically, the conjectured reason that the crystalline MgO layer 5 causes the improvement of the discharge characteristics (a reduction in discharge delay, an increase in the discharge probability) is because the vapor-phase MgO single crystal causing the CL emission having a peak within the wavelength range from 200 nm to 300 nm (particularly, from 230 nm to 250 nm, around 235 nm) has an energy level corresponding to the peak wavelength, so that the energy level enables the trapping of electrons for long time (some msec. or more), and the trapped electrons are extracted by an electric field so as to serve as the primary electrons required for starting a discharge.

Also, because of the co-relationship between the intensity of the CL emission and the particle size of the vapor-phase MgO single crystal, the stronger the intensity of the CL emission having a peak within the wavelength range from 200 nm to 300 nm (particularly, from 230 nm to 250 nm, around 235 nm), the greater the effect of improving the discharge characteristics (a reduction in discharge delay, an increase in the discharge probability) caused by the vapor-phase MgO single crystal.

In other words, when a vapor-phase MgO single crystal to be deposited has a large particle size, an increase in the heating temperature for generating magnesium vapor is required. Because of this, the length of flame with which magnesium and oxygen react increases, and therefore the temperature difference between the flame and the surrounding ambience increases. Thus, it is conceivable that the larger the particle size of the vapor-phase MgO single crystal, the greater the number of energy levels occurring in correspondence with the peak wavelengths (e.g. within a range from 230 nm to 250 nm, around 235 nm) of the CL emission as described earlier.

In a further conjecture regarding the vapor-phase MgO single crystal of a cubic polycrystal structure, many plane defects occur, and the presence of energy levels arising from these plane defects contributes to an improvement in discharge probability.

The BET specific surface area (s) is measured by a nitrogen adsorption method. From the measured value, the particle diameter ($D_{BET}$) of the vapor-phase MgO single crystal forming the crystalline MgO layer 5 is calculated by the following equation.

$$D_{BET}=A/(s\times\rho),$$

where

A: shape count (A=6)

ρ: real density of magnesium.

Figure 11:
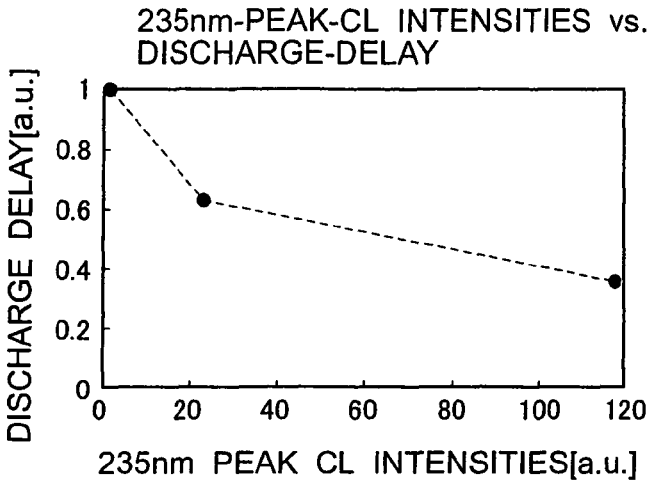
FIG. 11 is a graph showing the relationship between the discharge delay and the peak intensities of CL emission at 235 nm from the magnesium oxide single crystal.

FIG. 11 is a graph showing the co-relationship between the CL emission intensities and the discharge delay.

It is seen from FIG. 11 that the display delay in the PDP is shortened by the 235-nm CL emission excited from the crystalline MgO layer 5, and further as the intensity of the 235-nm CL emission increases, the discharge delay time is shortened (i.e. the discharge probability is improved).

Figure 12:
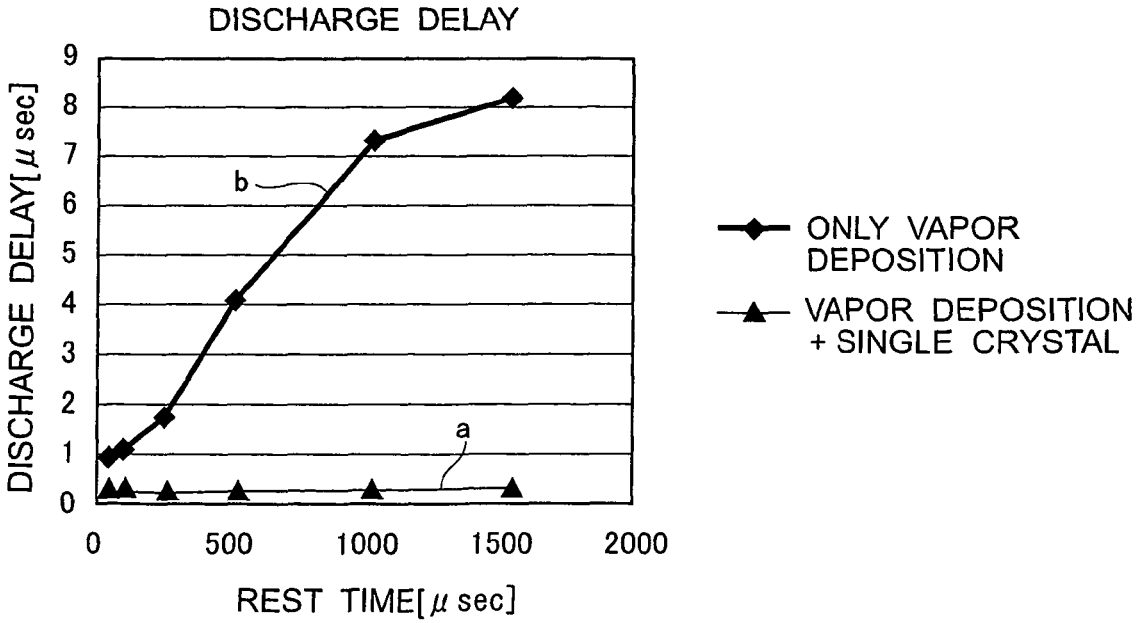
FIG. 12 is a graph showing the comparison of the discharge delay characteristics between the case when the protective layer is constituted only of the magnesium oxide layer formed by vapor deposition and that when the protective layer has a double layer structure made up of a crystalline magnesium layer and a thin film magnesium layer formed by vapor deposition.

FIG. 12 shows the comparison of the discharge delay characteristics between the case of the PDP having the double-layer structure of the thin-film MgO layer 4 and the crystalline MgO layer 5 as described earlier (Graph a), and the case of a conventional PDP having only a MgO layer formed by vapor deposition (Graph b).

As seen from FIG. 12, the double-layer structure of the thin-film MgO layer 4 and the crystalline MgO layer 5 of the PDP according to the present invention offers a significant improvement in the discharge delay characteristics of the PDP over that of a conventional PDP having only a thin-film MgO layer formed by vapor deposition.

As described hitherto, the PDP of the present invention has, in addition to the conventional type of the thin-film MgO layer 4 formed by vapor deposition or the like, the crystalline MgO layer 5 laminated and including the MgO crystal that causes a CL emission having a peak within a wavelength range from 200 nm to 300 nm upon excitation by an electron beam. Because of this design, a decrease in the discharge probability of the address discharge is prevented even in a PDP provided with a grid-shaped partition wall unit 8 to block off adjacent discharge cells C in the column direction from each other. In consequence, it is possible to realize compatibility between the effect of improving the discharge probability, and an improvement in brightness of the PDP and an increase in the number of gray levels which are achieved by providing the partition wall unit 8.

The MgO crystal used for forming the crystalline MgO layer 5 has an average particle diameter of 500 or more angstroms based on a measurement using the BET method, preferably, of a range from 2000 Å to 4000 Å.

There is not necessarily a need to form the crystalline MgO layer 5 covering the entire rear-facing face of the thin-film MgO layer 4 as described earlier. For example, the crystalline MgO layers 5 may be formed partially on portions of the thin-film MgO layer 4 which are opposite the transparent electrodes Xa, Ya of the row electrodes X, Y or alternatively are not opposite the transparent electrodes Xa, Ya, through a patterning process.

In the case of partially forming the crystalline MgO layers 5, the area ratio of the crystalline MgO layer 5 to the thin-film MgO layer 4 is set in a range from 0.1% to 85%, for example.

The foregoing has described the example when the present invention applies to a reflection type AC PDP having the front glass substrate on which row electrode pairs are formed and covered with a dielectric layer and the back glass substrate on which phosphor layers and column electrodes are formed. However, the present invention is applicable to various types of PDPs, such as a reflection-type AC PDP having row electrode pairs and column electrodes formed on the front glass substrate and covered with a dielectric layer, and having phosphor layers formed on the back glass substrate; a transmission-type AC PDP having phosphor layers formed on the front glass substrate, and row electrode pairs and column electrodes formed on the back glass substrate and covered with a dielectric layer; a three-electrode AC PDP having discharge cells formed in the discharge space in positions corresponding to the intersections between row electrode pairs and column electrodes; a two-electrode AC PDP having discharge cells formed in the discharge space in positions corresponding to the intersections between row electrode and column electrodes.

Further, the foregoing has described the example when the crystalline MgO layer 5 is formed through affixation by use of a spraying technique, an electrostatic coating technique or the like. However, the crystalline MgO layer 5 may be formed through application of a coating of a paste including MgO crystal by use of a screen printing technique, an offset printing technique, a dispenser technique, an inkjet technique, a roll-coating technique of the like. Alternatively, for forming the crystalline MgO layer 5, a coating of a paste including an MgO crystal may be applied onto a support film and then dried to a film, and then this film may be laminated on the thin-film MgO layer.

Figure 13:
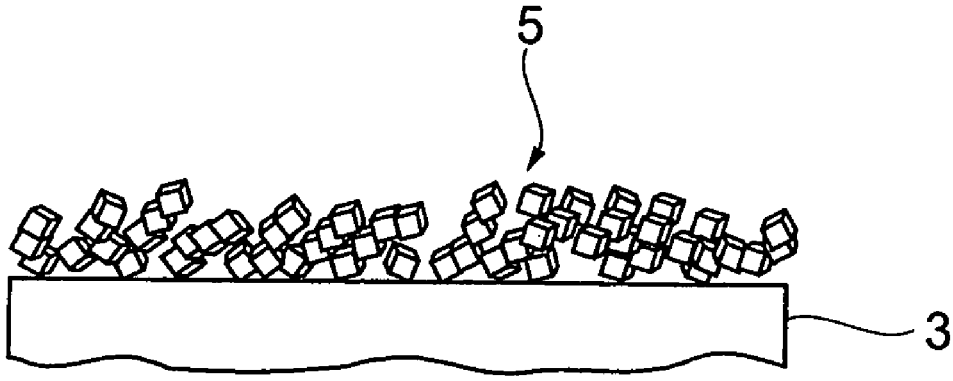
FIG. 13 is a sectional view illustrating the state of the crystalline magnesium layer formed as a single layer in the embodiment.

Further, the foregoing has described the example of the PDP having the double layer structure made up of the thin-film MgO layer 4 and the crystalline MgO layer 5 laminated thereon. However, the single-crystalline MgO layer 5 alone may be formed as a single layer on the dielectric layer 3 as illustrated in FIG. 13.

Still further, in the foregoing PDP, without forming the additional portions on the dielectric layer, the transverse wall of the partition wall unit may be partly or wholly formed smaller in height than the vertical wall, so at to secure an exhaust path between the adjacent discharge cells in the column direction. Alternatively, the vertical wall may be partly or wholly formed smaller in height than the transverse wall so as to secure an exhaust path between the adjacent discharge cells in the row direction.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel equipped with a front substrate and a back substrate facing each other on either side of a discharge space, a plurality of row electrode pairs formed on either the front substrate or the back substrate, a plurality of column electrodes formed on either the front substrate or the back substrate, and a dielectric layer covering the row electrode pairs, the plasma display panel comprising:

a partition wall unit that is provided between the front substrate and the back substrate for partitioning the discharge space into unit light emission areas each corresponding to an intersection between the row electrode pair and the column electrode, and formed in an approximate grid shape having transverse walls and vertical walls surrounding the unit light emission areas individually; and a protective layer that covers the dielectric layer and has a crystalline magnesium oxide layer arranged on a thin-film magnesium oxide layer, the crystalline magnesium oxide layer including a magnesium oxide crystal having a particle diameter of 2000 or more angstroms and capable of emitting a cathode-luminescence emission having a peak within a wavelength range from 230 nm to 250 nm, wherein the magnesium oxide crystal is exposed to the discharge space, and wherein each of the row electrodes constituting each row electrode pair has an electrode body extending in a row direction and a plurality of electrode protrusions each extending out from the electrode body toward its counterpart row electrode in the row electrode pair to a position opposite a corresponding electrode protrusion of the counterpart row electrode with a discharge gap in between, the opposing electrode protrusions facing each unit light emission area.

2. A plasma display panel according to claim 1, wherein each of the electrode protrusions has a wide portion opposite the corresponding electrode protrusion of the counterpart row electrode with the discharge gap in between, and a narrow portion connecting the wide portion and the electrode body.

3. A plasma display panel equipped with a front substrate and a back substrate facing each other on either side of a discharge space, a plurality of row electrode pairs formed on either the front substrate or the back substrate, a plurality of column electrodes formed on either the front substrate or the back substrate, and a dielectric layer covering the row electrode pairs, the plasma display panel comprising:

a partition wall unit that is provided between the front substrate and the back substrate for partitioning the discharge space into unit light emission areas each corresponding to an intersection between the row electrode pair and the column electrode, and formed in an approximate grid shape having transverse walls and vertical walls surrounding the unit light emission areas individually; and a protective layer that covers the dielectric layer and has a crystalline magnesium oxide layer arranged on a thin-film magnesium oxide layer, the crystalline magnesium oxide layer including a magnesium oxide crystal having a particle diameter of 2000 or more angstroms and capable of emitting a cathode-luminescence emission having a peak within a wavelength range from 230 nm to 250 nm, wherein the magnesium oxide crystal is exposed to the discharge space, and wherein each of the transverse walls of the partition wall unit has a part having a height lower than that of the vertical wall.

4. A plasma display panel equipped with a front substrate and a back substrate facing each other on either side of a discharge space, a plurality of row electrode pairs formed on either the front substrate or the back substrate, a plurality of column electrodes formed on either the front substrate or the back substrate, and a dielectric layer covering the row electrode pairs, the plasma display panel comprising:

a partition wall unit that is provided between the front substrate and the back substrate for partitioning the discharge space into unit light emission areas each corresponding to an intersection between the row electrode pair and the column electrode, and formed in an approximate grid shape having transverse walls and vertical walls surrounding the unit light emission areas individually; and a protective layer that covers the dielectric layer and has a crystalline magnesium oxide layer arranged on a thin-film magnesium oxide layer, the crystalline magnesium oxide layer including a magnesium oxide crystal having a particle diameter of 2000 or more angstroms and capable of emitting a cathode-luminescence emission having a peak within a wavelength range from 230 nm to 250 nm, wherein the magnesium oxide crystal is exposed to the discharge space, and wherein each of the vertical walls of the partition wall unit has a part having a height lower than that of the transverse wall.

5. A plasma display panel according to claim 3, wherein the magnesium oxide crystal is a magnesium oxide single-crystal produced by use of a vapor-phase oxidation technique.

6. A plasma display panel according to claim 3, wherein the magnesium oxide crystal is a magnesium oxide single-crystal having a cubic single crystal structure.

7. A plasma display panel according to claim 3, wherein the magnesium oxide crystal is a magnesium oxide single crystal having a cubic polycrystal structure.

8. A plasma display panel according to claim 3, wherein the protective layer has a lamination structure constituted of the crystalline magnesium oxide layer and a thin-film magnesium oxide film formed by either vapor deposition or spattering.

9. A plasma display panel according to claim 3, wherein the protective layer has a single layer structure constituted of the crystalline magnesium oxide layer.

10. The plasma display panel according to claim 3, wherein the protective layer entirely covers a rear-facing surface of the dielectric layer.

11. The plasma display panel according to claim 3, wherein the crystalline magnesium oxide layer entirely covers a rear-facing surface of the thin-film magnesium oxide layer.

12. The plasma display panel according to claim 3, wherein the magnesium oxide crystal is capable of emitting a cathode-luminescence emission having a peak of approximately 235 nm.

13. A plasma display panel equipped with a front substrate and a back substrate facing each other on either side of a discharge space, a plurality of row electrode pairs formed on either the front substrate or the back substrate, a plurality of column electrodes formed on either the front substrate or the back substrate, and a dielectric layer covering the row electrode pairs, the plasma display panel comprising:

a partition wall unit that is provided between the front substrate and the back substrate for partitioning the discharge space into unit light emission areas each corresponding to an intersection between the row electrode pair and the column electrode, and formed in an approximate grid shape having transverse walls and vertical walls surrounding the unit light emission areas individually;

a protective layer that covers the dielectric layer and has a crystalline magnesium oxide layer arranged on a thin-film magnesium oxide layer, the crystalline magnesium oxide layer including a magnesium oxide crystal having a particle diameter of 2000 or more angstroms and capable of emitting a cathode-luminescence emission having a peak within a wavelength range from 230 nm to 250 nm; and a column electrode protective layer covering the column electrodes, said partition wall unit being formed on the column electrode protective layer, wherein the magnesium oxide crystal is exposed to the discharge space.

14. The plasma display panel according to claim 13, further comprising a phosphor layer covering the partition wall unit and the column electrode protective layer.

15. A plasma display panel equipped with a front substrate and a back substrate facing each other on either side of a discharge space, a plurality of row electrode pairs formed on either the front substrate or the back substrate, a plurality of column electrodes formed on either the front substrate or the back substrate, and a dielectric layer covering the row electrode pairs, the plasma display panel comprising:

a partition wall unit that is provided between the front substrate and the back substrate for partitioning the discharge space into unit light emission areas each corresponding to an intersection between the row electrode pair and the column electrode, and formed in an approximate grid shape having transverse walls and vertical walls surrounding the unit light emission areas individually;

a protective layer that covers the dielectric layer and has a crystalline magnesium oxide layer arranged on a thin-film magnesium oxide layer, the crystalline magnesium oxide layer including a magnesium oxide crystal having a particle diameter of 2000 or more angstroms and capable of emitting a cathode-luminescence emission having a peak within a wavelength range from 230 nm to 250 nm; and a clearance between the crystalline magnesium oxide layer and the vertical walls of the partition wall unit, wherein the magnesium oxide crystal is exposed to the discharge space.

16. A plasma display panel according to claim 4, wherein the magnesium oxide crystal is a magnesium oxide single-crystal produced by use of a vapor-phase oxidation technique.

17. A plasma display panel according to claim 4, wherein the magnesium oxide crystal is a magnesium oxide single-crystal having a cubic single crystal structure.

18. A plasma display panel according to claim 4, wherein the magnesium oxide crystal is a magnesium oxide single crystal having a cubic polycrystal structure.

19. A plasma display panel according to claim 4, wherein the protective layer has a lamination structure constituted of the crystalline magnesium oxide layer and a thin-film magnesium oxide film formed by either vapor deposition or spattering.

20. A plasma display panel according to claim 4, wherein the protective layer has a single layer structure constituted of the crystalline magnesium oxide layer.

21. A plasma display panel according to claim 4, wherein the protective layer entirely covers a rear-facing surface of the dielectric layer.

22. A plasma display panel according to claim 4, wherein the crystalline magnesium oxide layer entirely covers a rear-facing surface of the thin-film magnesium oxide layer.

23. A plasma display panel according to claim 4, wherein the magnesium oxide crystal is capable of emitting a cathode-luminescence emission having a peak of approximately 235 nm.

* * * * *